United States Patent [19]

Evans

[11] Patent Number: 4,615,162

[45] Date of Patent: Oct. 7, 1986

[54] INSULATED WALL CONSTRUCTION

[75] Inventor: Michael E. Evans, Granville, Ohio

[73] Assignee: Owens-Corning Fiberglas Corporation, Toledo, Ohio

[21] Appl. No.: 787,553

[22] Filed: Oct. 15, 1985

[51] Int. Cl.[4] ..... E04B 5/52

[52] U.S. Cl. ..... 52/409; 52/417; 428/255

[58] Field of Search ..... 52/417, 344, 454, 409; 428/255, 258

[56] References Cited

U.S. PATENT DOCUMENTS

| | | | |
|---|---|---|---|
| 823,052 | 6/1906 | Klotz | 52/417 |
| 1,448,886 | 3/1923 | Walper | 52/417 |
| 1,461,590 | 7/1923 | Walper | 52/417 |
| 1,467,127 | 9/1923 | Walper | 52/417 |
| 2,147,667 | 2/1939 | Patterson | 52/344 |
| 3,391,037 | 7/1968 | McNulty | 52/417 |
| 4,522,004 | 6/1985 | Evans et al. | 52/417 |
| 4,525,970 | 7/1985 | Evans | 52/454 |

*Primary Examiner*—James L. Ridgill, Jr.

*Attorney, Agent, or Firm*—Ronald C. Hudgens; Ted C. Gillespie; Paul J. Rose

[57] ABSTRACT

A wall construction comprising a plurality of horizontally spaced vertically extending studs, an insulation board mounted on an outer side of the studs, a scrim adhered to an outer side of the board, fastening means mechanically securing the board and scrim to the studs, and a coat of cementitious material covering the board, scrim, and fastening means, at least one of the studs being disposed between opposite vertical edge portions of the board, and the scrim having a greater number of vertically extending strands per inch of width in the vicinity of said at least one stud than in areas between the studs.

22 Claims, 3 Drawing Figures

INSULATED WALL CONSTRUCTION

TECHNICAL FIELD

This invention relates generally to insulation of outside walls of buildings, and more particularly to wall constructions wherein fibrous insulation boards are secured to wood studs, the boards having a factory-applied scrim adhered thereto for reinforcing a field-applied cementitious coating.

BACKGROUND ART

U.S. Pat. No. 4,522,004 discloses a wall construction of the above-described type wherein the scrim has about six by six strands per square inch (column 2, lines 16–19). When staples with leg portions spaced on three-eighths-inch centers are used to secure the insulation boards, only two strands are held by a staple.

DISCLOSURE OF INVENTION

In accordance with the invention, the scrim adhered to the insulation board in the factory is non-uniform, having five by five strands per square inch in areas falling between studs when the boards are installed, and twelve by five strands per square inch in two spaced areas of the board aligned with studs when the boards are installed. Each staple holds four strands of the denser scrim in the stud area of the board. Negative wind load resistance is increased over that of the former construction, and less yarn is required in the scrim, while the cement coat is still adequately reinforced.

BRIEF DESCRIPTION OF DRAWINGS

The invention is hereinafter more fully described, reference being had to the accompanying drawings herein.

BEST MODE OF CARRYING OUT THE INVENTION

Figure 1:
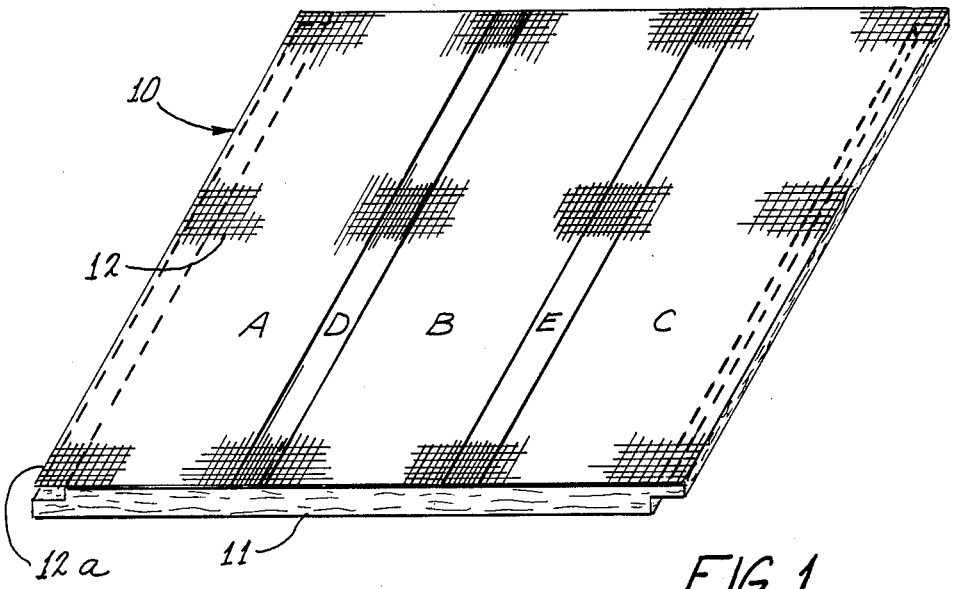
FIG. 1 is an isometric view of an insulation board constructed in accordance with the invention.

With reference to the drawings, FIG. 1 shows an insulation board 10 constructed in accordance with the invention and including a glass fiber board 11 having a density of about four pounds per cubic foot, preferably having a thickness of at least one inch, and consisting essentially of glass fibers impregnated with about thirteen percent by weight of a binder such as phenol-urea-formaldehyde resin. The insulation board 10 also includes a scrim 12, preferably woven alkali-resistant or plastic-coated glass fiber, adhered to an outer side of the glass fiber board 11. Opposite, normally vertical edges of the glass fiber board 11 are rabbeted to provide shiplap-type joints between adjacent mounted boards. The full-thickness portion of the board 11 may be forty-six inches wide, and each of the rabbeted portions may project two inches. Preferably the board 11 is eight feet high. The scrim 12 may be fifty inches wide, including a loose flap 12*a* at one rabbeted edge.

Figure 2:
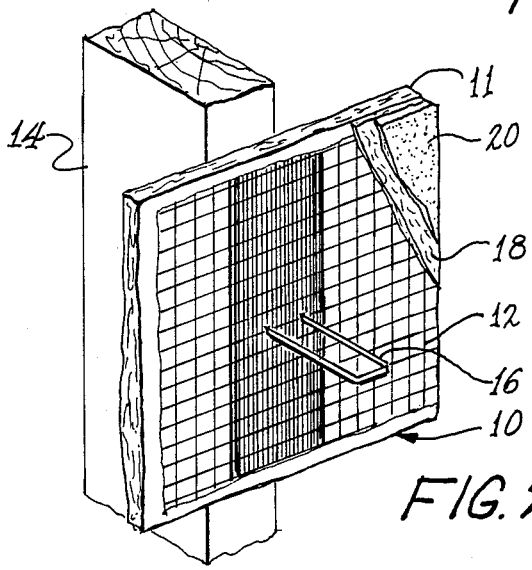
FIG. 2 is a fragmentary schematic isometric view of a wall constructed in accordance with the invention.
Figure 3:
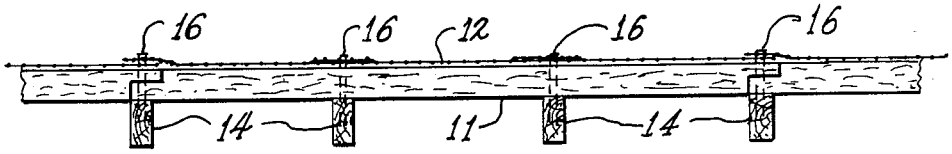
FIG. 3 is a fragmentary plan view of a wall constructed in accordance with the invention.

In accordance with the invention, the scrim 12 is provided with five by five strands per square inch in areas labelled "A", "B" and "C", but with twelve by five strands per square inch in areas labelled "D" and "E", the twelve strands running vertically on a mounted board. The areas D and E are preferably four inches wide and disposed on sixteen-inch centers to match normal spacing of wood studs such as studs 14 shown in FIGS. 2 and 3. The boards 10 may be stapled to the studs 14 by staples 16 and covered with a rough cementitious coat 18 and a finish coat 20.

While the additional vertical strands in the stud area are preferably built into a non-uniform scrim, it is within the scope of the invention to use uniform scrim all across the board and place additional scrim strips vertically along the stud areas.

With twelve vertical strands per inch of width in areas D and E, a staple 16 will enclose twice as many strands, namely four, than with six vertical strands per inch, as in the prior uniform scrim having six by six strands per square inch all the way across an insulation board. Wind load tests show that this results in a stronger wall, even with using less glass yarn in the scrim overall.

The six by six scrim has twelve inches of yarn (6 +6) in a square inch. The scrim of this invention has ten inches of yarn (5+5) per square inch in areas A, B, and C, and seventeen inches of yarn (12+5) per square inch in areas D and E. This averages out to 11.12 inches of yarn per square inch when the eight-inches total width of areas D and E and the forty-two inches total width of areas A, B, and C are taken into consideration, or 92.66% as much yarn as in the six by six scrim.

In negative wind load tests, the former panel failed at 57 pounds per square foot, while the panel of this invention did not fail at 14.6 inches of water, the maximum vacuum available with the equipment, or 76 pounds per square foot.

Various modifications may be made in the structure shown and described without departing from the spirit and scope of the invention as set forth in the appended claims.

I claim:

1. An insulated outer wall construction for a building, said wall construction comprising a plurality of predeterminedly generally equally horizontally spaced vertically extending studs, a generally rectangular fibrous insulation board mounted in covering relationship to said studs on a side thereof facing outwardly of the building, said board having a first vertical edge portion generally aligned with a first of said studs and a second vertical edge portion generally aligned with a second of said studs spaced from said first stud by at least one other stud therebetween, said board having a non-uniform scrim adhesively secured thereto on an outer side thereof and extending substantially from said first vertical edge portion to said second vertical edge portion, fastening means mechanically securing said board and scrim to said studs, and a coat of cementitious material covering said board, scrim, and fastening means, said scrim having a predetermined first number of vertically extending strands per inch of width in areas thereof between adjacent studs and having a predetermined second number of vertically extending strands per inch of width in the area thereof generally aligned with said at least one other stud, said second number being greater than said first number.

2. The board and adhered non-uniform scrim of the wall construction of claim 1.

3. A wall construction as claimed in claim 1 wherein said second number is about twice as large as said first number.

4. A wall construction as claimed in claim 1 wherein the scrim is glass fiber scrim.

5. A wall construction as claimed in claim 1 wherein the scrim has five horizontally extending strands per inch of height throughout the height of the insulation board, has twelve vertically extending strands per inch of width in the vicinity of said at least one other stud, and has five vertically extending strands per inch of width in areas between said studs.

6. A wall construction as claimed in claim 1 wherein said first and second vertical edge portions of the insulation board are rabbeted respectively on opposite sides of the board to provide shiplap-type joints respectively with adjacent mounted boards.

7. A wall construction as claimed in claim 6 wherein the scrim includes a flap along a vertical edge portion of the board rabbeted on a side thereof facing the scrim, for overlapping a joint with an adjacent mounted board and providing a double thickness of scrim thereat.

8. A wall construction as claimed in claim 1 wherein the insulation board is a fibrous glass board.

9. A wall construction as claimed in claim 8 wherein the fibrous glass board has a density of about four pounds per cubic foot.

10. A wall construction as claimed in claim 8 wherein the fibrous glass board comprises glass fibers impregnated with about thirteen percent by weight of a resin binder.

11. A wall construction as claimed in claim 1 wherein said first and second studs are spaced from each other by two other studs therebetween, and said scrim has said predetermined second number of vertically extending strands per inch of width in areas thereof generally aligned respectively with said two other studs.

12. A board and non-uniform scrim as claimed in claim 11 wherein said second number is about twice as large as said first number.

13. For mounting on one side of a plurality of predeterminedly generally equally horizontally spaced vertically extending studs in the construction of an insulated wall, a generally rectangular fibrous insulation board having a non-uniform scrim extending across and adhesively secured to one of its major faces, said board and non-uniform scrim being so constructed and arranged that when the board is mounted on the studs with a first vertical edge portion thereof generally aligned with a first of said studs and a second vertical edge portion thereof generally aligned with a second of said studs spaced from said first stud by at least one other stud therebetween, said scrim has a predetermined first number of vertically extending strands per inch of width in areas thereof between adjacent studs and a predetermined second number of vertically extending strands per inch of width in the area thereof generally aligned with said at least one other stud, said second number being greater than said first number.

14. A fibrous insulation board as claimed in claim 13 wherein the scrim is glass fiber scrim.

15. A fibrous insulation board as claimed in claim 13 wherein the scrim has five horizontally extending strands per inch of height throughout the height of the board, has twelve vertically extending strands per inch of width in the vicinity of said at least one other stud, and has five vertically extending strands per inch of width in areas between said studs when the board is mounted thereon.

16. A fibrous insulation board as claimed in claim 13 wherein said first and second vertical edge portions are rabbeted respectively on opposite sides of the board to provide shiplap-type joints respectively with adjacent mounted boards.

17. A fibrous insulation board as claimed in claim 16 wherein the scrim includes a flap along a vertical edge portion of the board rabbeted on a side thereof facing the scrim, for overlapping a joint with an adjacent mounted board and providing a double thickness of scrim thereat.

18. A fibrous insulation board as claimed in claim 13 wherein the board is made of fibrous glass.

19. A fibrous insulation board as claimed in claim 18 wherein the board has a density of about four pounds per cubic foot.

20. A fibrous insulation board as claimed in claim 18 wherein the fibrous glass is impregnated with about thirteen percent by weight of a resin binder.

21. For mounting on one side of a plurality of predeterminedly generally equally horizontally spaced vertically extending studs in the construction of an insulated wall, a generally rectangular fibrous insulation board having a non-uniform scrim extending across and adhesively secured to one of its major faces, said board and scrim being so constructed and arranged that when the board is mounted on the studs with a first vertical edge portion thereof generally aligned with a first of said studs and a second vertical edge portion thereof generally aligned with a second of said studs spaced from said first stud by two other studs therebetween, said scrim has a predetermined first number of vertically extending strands per inch of width in areas thereof between adjacent studs and a predetermined second number of vertically extending strands per inch of width in areas thereof generally aligned respectively with said two other studs, said second number being greater than said first number.

22. A board and non-uniform scrim as claimed in claim 21 wherein said second number is about twice as large as said first number.

* * * * *